US010360836B2

(12) United States Patent
Chen

(10) Patent No.: US 10,360,836 B2
(45) Date of Patent: Jul. 23, 2019

(54) DRIVING DEVICE FOR A DISPLAY PANEL, DISPLAY DEVICE AND DRIVING METHOD OF DISPLAY PANEL

(71) Applicants: HKC Corporation Limited, Shenzhen (CN); Chongqing HKC Optoelectronics Technology Co., ltd., Chongqing (CN)

(72) Inventor: Yu-Jen Chen, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 15/849,749

(22) Filed: Dec. 21, 2017

(65) Prior Publication Data

US 2019/0027086 A1 Jan. 24, 2019

Related U.S. Application Data

(63) Continuation of application No. PCT/CN2017/102463, filed on Sep. 20, 2017.

(30) Foreign Application Priority Data

Jul. 21, 2017 (CN) ..... 2017 1 0602847

(51) Int. Cl.
*G09G 3/36* (2006.01)
*G09G 3/20* (2006.01)

(52) U.S. Cl.
CPC ..... *G09G 3/2077* (2013.01); *G09G 3/3607* (2013.01); *G09G 3/3677* (2013.01); *G09G 3/3688* (2013.01); *G09G 2300/0426* (2013.01); *G09G 2310/0251* (2013.01); *G09G 2310/08* (2013.01); *G09G 2320/0242* (2013.01); *G09G 2320/0626* (2013.01)

(58) Field of Classification Search
CPC ... G09G 2300/0439; G09G 2300/0443; G09G 2300/0452; G09G 2300/0456; G09G 2310/08; G09G 3/3674
See application file for complete search history.

(56) References Cited

U.S. PATENT DOCUMENTS

2015/0187314 A1* 7/2015 Choi ..... G09G 3/3677 345/99
2016/0246136 A1* 8/2016 Lim ..... G09G 3/3607
2018/0047361 A1* 2/2018 Hsu ..... G09G 3/3607

* cited by examiner

*Primary Examiner* — Roy P Rabindranath
(74) *Attorney, Agent, or Firm* — WPAT PC

(57) ABSTRACT

A driving device for a display panel, a display device and a driving method of a display panel are provided. The driving device for a display panel includes numerous sub-pixels. Each of the sub-pixels includes a first display region, a second display region, a first scanning line and a second scanning line. The first scanning line and the first display regions are connected. The second scanning line and the second display regions are connected. The driving device for a display panel further includes a gate driving unit. The gate driving unit is connected to the first scanning line and the second scanning line. The gate driving unit respectively controls charging times of the first display region and the second display region by the first scanning line and the second scanning line.

8 Claims, 4 Drawing Sheets

DRIVING DEVICE FOR A DISPLAY PANEL, DISPLAY DEVICE AND DRIVING METHOD OF DISPLAY PANEL

FIELD OF THE DISCLOSURE

The disclosure relates to a display field, and more particularly to a driving device for a display panel, a display device and a driving method of a display panel.

BACKGROUND

A liquid crystal display has color cast from various viewing angles. Generally, a pixel includes three sub-pixels—R, G, and B. The pixel brightness will be proper viewed from the front side. The pixel brightness will be weaker viewed from the lateral side. The difference exists between the viewing from the front side and the lateral side. The conventional adjustment of a display is based on the brightness of the front side view. The effect is thereby optimal viewed from the front. Correspondingly, the color cast will appear in the lateral view, and the quality will be degraded.

SUMMARY

Accordingly, aiming at the problem of color cast viewed from a lateral side of a liquid crystal display, a display panel and a display device capable of reducing color cast by changing the charging time of various regions of sub-pixels are required to be provided.

A driving device for a display panel includes numerous sub-pixels, a first scanning line, a second scanning line and a gate driving unit.

Each of the sub-pixels includes a first display region and a second display region.

The first scanning line and the first display regions are connected. The second scanning line and the second display regions are connected.

The gate driving unit is individually connected to the first scanning line and the second scanning line.

The gate driving unit controls charging times of the first display region and the second display region by the first scanning line and the second scanning line and thereby to control grayscale displays of the first display region and the second display region.

In one of the embodiments, the gate driving unit is disposed with a timing controller. The timing controller is configured to govern duty ratios of high level scanning signals.

The timing controller is configured to control the charging times of the first display region and the second display region respectively through adjusting the duty ratios of the high level scanning signals.

In one of the embodiments, the gate driving unit further includes an output enable controller connected to the timing controller.

The timing controller is configured to make the output enable controller to output control signals by dominating the duty ratios of the high level scanning signals. The control signals are configured to control the first display region and the second display region to be charged or powered off.

In one of the embodiments, the output enable controller includes a first field effect transistor and a second field effect transistor.

A source electrode of the first field effect transistor and a gate electrode of the second field effect transistor are connected. The source electrode of the first field effect transistor and the gate electrode of the second field effect transistor are connected to a power supply. A drain electrode of the first field effect transistor and a drain electrode of the second field effect transistor are grounded.

A gate electrode of the first field effect transistor is configured to be input with a signal output from the timing controller, and the signal is the high level scanning signal with adjusted duty ratio.

In one of the embodiments, the gate driving unit further includes a voltage converting circuit. The voltage converting circuit and the output enable controller are connected; the voltage converting circuit is configured to convert the control signals output from the output enable controller to scanning voltages for governing the first display region and the second display region to be charged.

A driving device for a display panel includes a source driving unit configured to output a data signal and numerous driving device for a display panels arranged in sequence. The source driving unit is configured to output a signal to charge the first display region and the second display region of each of the sub-pixels. The gate driving unit is configured to control times of data signal charging the first display region and the second display region respectively by the first scanning line and the second scanning line.

In one of the embodiments, the first display regions and the second display regions respectively are disposed with a first switch and a second switch configured to control the first display region and the second display region to be charged. The first switch and the second switch respectively are connected to the first scanning line and the second scanning line. The gate driving unit controls the first switch and the second switch to be turned on or off respectively by the first scanning line and the second scanning line.

In one of the embodiments, the source driving unit further is disposed with a data line. The data line is connected to a source electrode of the first switch and a source electrode of the second switch in each of the sub-pixels. The gate driving unit controls the first switch or the second switch to be turned on to enable the source driving unit to charge the first display region and the second display region through the data line.

A driving device for a display panel includes numerous sub-pixels, a gate driving unit, a first scanning line, a second scanning line, a source driving unit and a data line.

Each of the sub-pixels includes a first display region and a second display region.

The gate driving unit includes a timing controller, an output enable controller and a voltage converting circuit. The timing controller, the output enable controller and the voltage converting circuit are electrically connected in sequence.

An end of the first scanning line and the first display regions are connected. Another end of the first scanning line and the voltage converting circuit are electrically connected; an end of the second scanning line and the second display regions are connected. Another end of the second scanning line and the voltage converting circuit are electrically connected.

The source driving unit is configured to output a data signal.

An end of the data line and the source driving unit are connected. Another end of the data line is connected to the first display region and the second display region.

The data signal output from the source driving unit charges the first display region and the second display region through the data line. The gate driving unit controls times of the data signal charging the first display region and the second display region respectively through the first scanning line and the second scanning line.

A driving method of a display panel includes: controlling switches of a first display region and a second display region of a sub-pixel to be turned on through a gate driving unit; after the switches of the first display region and the second display region are turned on, charging the first display region and the second display region through a source driving unit; controlling times to turn off the switches of the first display region and the second display region through the gate driving unit, and thereby times of charging the first display region and the second display region through the source driving unit are controlled.

The driving device for a display panel provided by the disclosure includes the first scanning line, the second scanning line, the gate driving unit and numerous sub-pixels. Each of the sub-pixels includes the first display region and the second display region. The first scanning line and the numerous first display regions are connected. The second scanning line and the numerous second display regions are connected. The gate driving unit is respectively connected to the first scanning line and the second scanning line. The gate driving unit controls the times of charging the first display region and the second display region by the first scanning line and the second scanning line. The brightness received by eyes is the brightness after neutralization of the first display regions and second display regions. The charging voltage of the first display regions and the second display regions can be controlled by governing the charging time of the first display regions and the second display regions, further dominating the display brightness of the first display regions and the second display regions. The brightness received by eyes is the brightness after neutralization of the first display regions and second display regions. The brightness of the sub-pixels after neutralization perceived by eyes can be adjusted by respectively modulating the brightness of the first display regions and the second display regions. The brightness of some relative dark display region in a lateral view can be enhanced according to requirements. The neutralized sub-pixels are brighter to prevent color cast viewed from a lateral side of a display.

DETAILED DESCRIPTION OF PREFERRED EMBODIMENTS

In order to better clarify the objective, embodiments and technical effects of the disclosure, concrete embodiments of the disclosure will be illustrated with reference to accompanying drawings as follows. The described concrete embodiments are for explaining the disclosure instead of limiting the disclosure.

Figure 1:
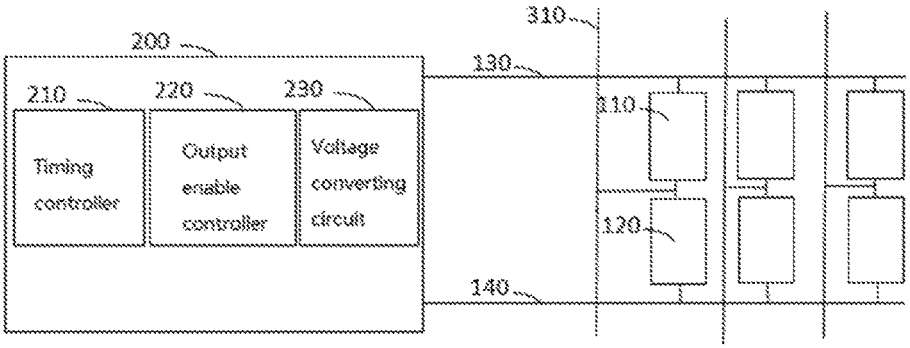
FIG. 1 is a schematic view of a driving device for a display panel according to an embodiment of the disclosure.

Referring to FIG. 1, the disclosure provides a driving device for a display panel 10. The driving device for a display panel 10 includes numerous sub-pixels 100. Each of the sub-pixels 100 includes a first display region 110 and a second display region 120. The driving device for a display panel 10 further includes a first scanning line 130 and a second scanning line 140. The first scanning line 130 and the numerous first display regions 110 are connected. The second scanning line 140 and the numerous second display regions 120 are connected. The driving device for a display panel 10 further includes a gate driving unit 200. The gate driving unit 200 may be referred to as a gate driving circuit. The gate driving unit 200 is connected to the first scanning line 130 and the second scanning line 140. Moreover, the gate driving unit 200 respectively controls the time for charging the first display regions 110 and the second display regions 120 by the first scanning line 130 and the second scanning line 140.

Preferably, the number of the sub-pixels 100 can be three. The three sub-pixels 100 can be ones respectively with three primary colors R, G and B. Each of the sub-pixels 100 can include numerous display regions. The first display regions 110 and the second display regions 120 form the display region of the sub-pixels 100. The first display regions 110 and the second display regions 120 are charged by the data line. The first scanning line 130 and the second scanning line 140 can control the time of the first display regions 110 and the second display regions 120 charged by the data line. Preferably, the first display regions 110 and the second display regions 120 can be directly connected to the data line. The brightness of the first display regions 110 and the second display regions 120 will be changed after being charged. The brightness of the first display regions 110 and the second display regions 120 can be measured by grayscale values. The grayscale values are corresponding to the charging time of the first display regions 110 and the second display regions 120, and the grayscale values can be altered according to the charged electric quantity of a liquid crystal capacitor.

Within the capacitance range of the liquid crystal capacitor, if the charging time is longer, the grayscale value of the first display region 110 or the second display regions 120 will be higher, and the brightness of the first display regions 110 or the second display regions 120 will be higher as well. The brightness of each of the sub-pixels 100 received by eyes is the brightness achieved by neutralization of the first display regions 110 and second display regions 120. The brightness judged by eyes can be changed by respectively adjusting the brightness of the first display region 110 and the second display region 120. Moreover, the visual brightness can be improved by adjusting the first display regions 110 and the second display regions 120 viewed from a lateral side of the display screen. Therefore, the gate driving unit 200 can control the charging time of the first display regions 110 and the second display regions 120 by the first scanning line 130 and the second scanning line 140 for further controlling the charging capacities of the first display regions 110 and the second display regions 120 respectively. The charging time of the first display regions 110 and the second display regions 120 can be respectively controlled by the gate driving unit 200 to govern the charging voltage of the first display regions 110 and the second display regions 120.

Figure 2:
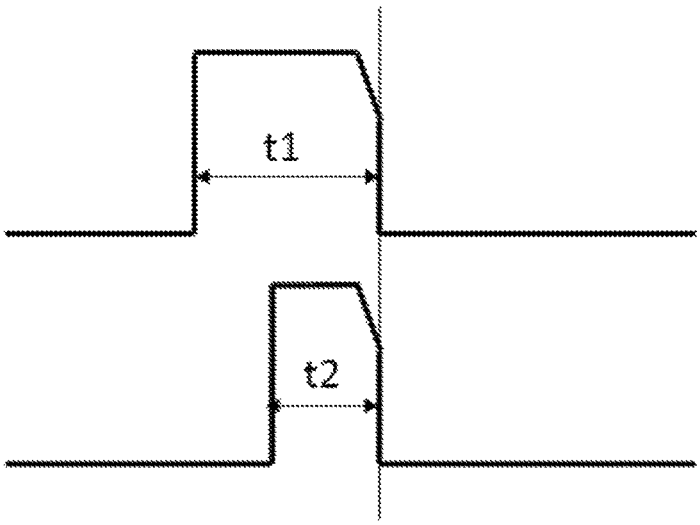
FIG. 2 is a schematic view of charging times of a first display region and a second display region according to an embodiment of the disclosure.

Referring to FIG. 2, the charging time of the first display regions 110 controlled by the gate driving unit 200 can be t1. The charging time of the second display regions 120 controlled by the gate driving unit 200 can be t2. In one of the embodiments, t1 is larger than t2, and the brightness of the first display regions 110 will be higher than the brightness of the second display regions 120. Optionally, t1 can be smaller than t2. The brightness received by eyes is neutralization of the brightness of the first display regions 110 and the brightness of the second display regions 120.

The driving device for a display panel provided by the disclosure includes the first scanning line 130, the second scanning line 140, a gate driving unit 200 and the numerous sub-pixels 100. Each of the sub-pixels 100 includes the first display region 110 and the second display region 120. The first scanning line 130 and the numerous first display regions 110 are connected. The second scanning line 140 and the numerous second display regions 120 are connected. The gate driving unit 200 is respectively connected with the first scanning line 130 and the second scanning line 140. The gate driving unit 200 respectively controls the charging time of the first display regions 110 and the second display regions 120 by the first scanning line 130 and the second scanning line 140. The brightness received by eyes is the neutralized brightness of the first display regions 110 and the second display regions 120. The charging voltage of the first display regions 110 and the second display regions 120 can be controlled by governing the charging time of the first display regions 110 and the second display regions 120, further to dominate the display brightness of the first display regions 110 and the second display regions 120. The problem of color cast viewed from the lateral side can be prevented by adjusting the charging time of the first display regions 110 and the second display regions 120.

In one of the embodiments, the gate driving unit 200 is disposed with a timing controller 210 configured to control duty ratios of high level scanning signals. The timing controller 210 respectively controls the charging time of the first display regions 110 and the second display regions 120 by adjusting the duty ratios of the high level scanning signals.

The timing controller 210 can consist of six circuits such as a power controlling circuit, a power converting circuit, a mechanical dialing timing circuit, a digital trigger, etc. The timing controller 210 can control the time and the sequence of the high level scanning signals. The timing controller 210 can control the time ratio of the high level scanning signals in a period. The first display regions 110 and the second display regions 120 can be charged when the high level scanning signals are sent.

Figure 3:
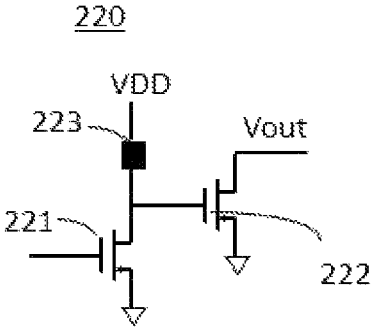
FIG. 3 is a logic diagram of an output enable controller according to an embodiment of the disclosure.

Referring to FIG. 3, in one of the embodiments, the gate driving unit 200 further includes an output enable controller 220 connected with the timing controller 210. The timing controller 210 makes the output enable controller 20 to output controlling signals by governing the duty ratios of the high level scanning signals. The controlling signals can be a high level signal and a low level signal. The high level signal and the low level signal are configured to control the first display regions 110 and the second display regions 120 to be charged or powered off. When the timing controller 210 generates the high level scanning signals, the output enable controller 220 generates the high level signal. When the high level scanning signal is absent, the output enable controller 220 generates the low level signal. The high level signal enables the first display regions 110 and the second display regions 120 to be charged. The first display regions 110 and the second display regions 120 cannot be charged when the low level signal is generated.

In one of the embodiments, the output enable controller 220 includes a first field effect transistor 221 and a second field effect transistor 222. A gate electrode of the first field effect transistor 221 is configured to input the signal to adjust the duty ratios of the high level scanning signals output from the timing controller 220. A source electrode of the first field effect transistor 221 and a gate electrode of the second field effect transistor 222 are connected. The source electrode of the first field effect transistor 221 and the gate electrode of the second field effect transistor 222 are further connected to the power supply. A drain electrode of the first field effect transistor 221 and a drain electrode of the second field effect transistor 222 respectively are grounded. The first field effect transistor 221 and the second field effect transistor 222 can be a junction field-effect transistor and an insulated gate field-effect transistor. The field effect transistor belongs to a voltage controlled semiconductor device. Advantages include high input resistance, low noise, low power consumption, a wide dynamic range, easy integration, absence of secondary breakdown, a wide range of safe operation, etc. The source electrode of the first field effect transistor 221 and the gate electrode of the second field effect transistor 222 are connected to the power supply by a resistor 223. The resistor 223 can have the function of dividing the voltage and limiting the current.

When the gate electrode of the first field effect transistor 221 inputs scanning signals, the first field effect transistor 221 is turned on and the second field effect transistor 222 is turned off. The source electrode of the second field effect transistor 222 outputs the high level signal; when the gate electrode of the first field effect transistor 221 has no scanning signals input, the source electrode of the second field effect transistor 222 outputs the low level signal.

Figure 4:
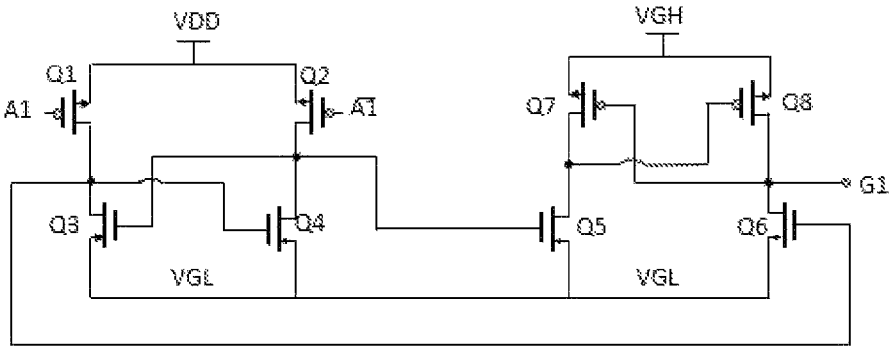
FIG. 4 is a logic diagram of a voltage converting circuit according to an embodiment of the disclosure.

Referring to FIG. 4, in one of the embodiments, the gate driving unit 200 further includes a voltage converting circuit 230. The voltage converting circuit 230 and the output enable controller 220 are connected. The voltage converting circuit 230 is configured to convert the high level signal and the low level signal output from the output enable controller 220 to the scanning voltage for controlling the first display regions 110 and the second display regions 120 to be charged. The voltage converting circuit 230 can convert the high level signal and the low level signal into the stable scanning voltage. The scanning voltage can control the first display regions 110 and the second display regions 120 to be charged. The voltage converting circuit 230 can include MOS transistor switches: Q1, Q2, Q3, Q4, Q5, Q6, Q7 and Q8. Q1, Q2, Q7 and Q8 are NMOS transistors. Q3, Q4, Q5 and Q6 are PMOS transistors. Q1 and Q2 both are connected to the power supply. Q7 and Q8 both are connected to the power supply. Q3, Q4, Q5 and Q6 are mutually connected. When a gate electrode of Q1 inputs the high level signal, Q1, Q4, Q6 and Q7 are turned off; Q2, Q3, Q5 and Q8 are turned on, and G1 outputs the high level scanning voltage. When the gate electrode of Q1 inputs the low level signal, Q1, Q4, Q6 and Q7 are turned on; Q2, Q3, Q5 and Q8 are turned off, and G1 outputs the low level scanning voltage.

Figure 5:
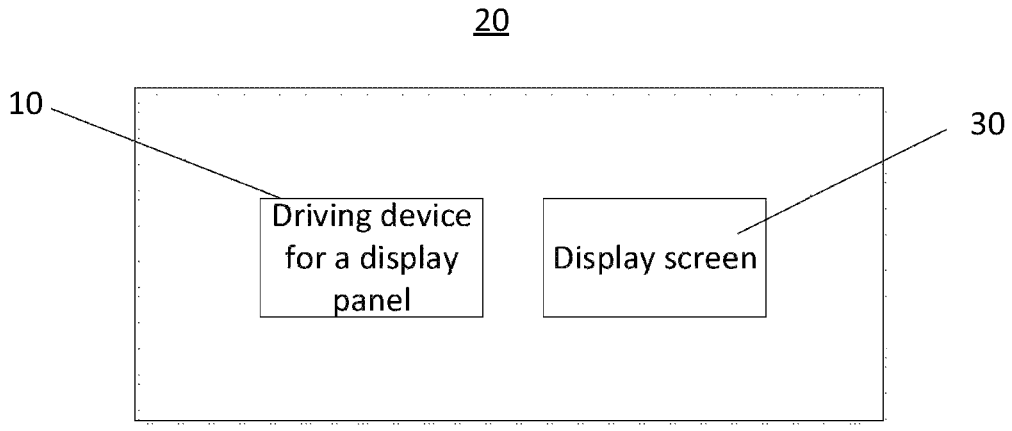
FIG. 5 is a schematic view of a display device according to an embodiment of the disclosure.

Referring to FIG. 5, an embodiment of the disclosure further provides a display device 20. The display device 20 includes a display screen 30. The display device 20 further includes the driving device for a display panel 10. The driving device for a display panel 10 and the display screen 30 are connected. The display device 20 includes a source driving unit 300 configured to output data signals. The source driving unit 300 is configured to charge the first display region 110 and the second display region 120 of each of the sub-pixels 100 by outputting signals. The source driving unit 300 respectively controls the time of the data signal charging first display regions 110 and the second display regions 120 by the first scanning line 130 and the second scanning line 140. The charging voltage of the first display regions 110 and the second display regions 120 can be controlled by governing the charging time of the first display regions 110 and the second display regions 120, further to dominate the display brightness of the first display regions 110 and the second display regions 120. The problem of color cast viewed from the lateral side can be prevented by adjusting the charging time of the first display regions 110 and the second display regions 120.

Figure 6:
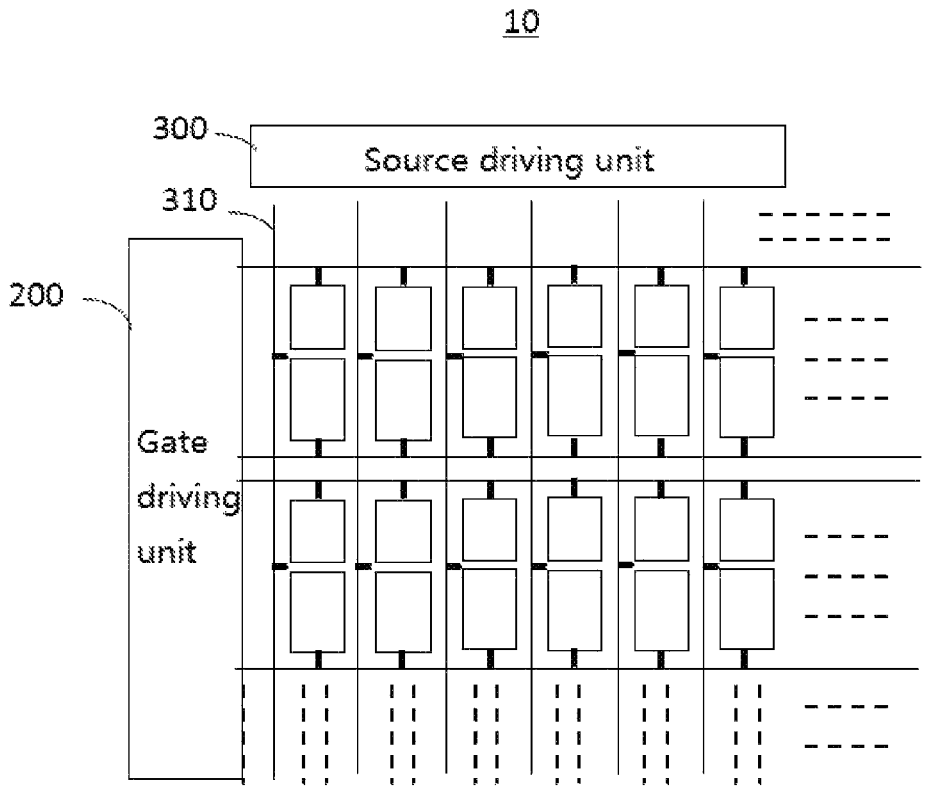
FIG. 6 is a schematic view of another display panel according to an embodiment of the disclosure.
Figure 7:
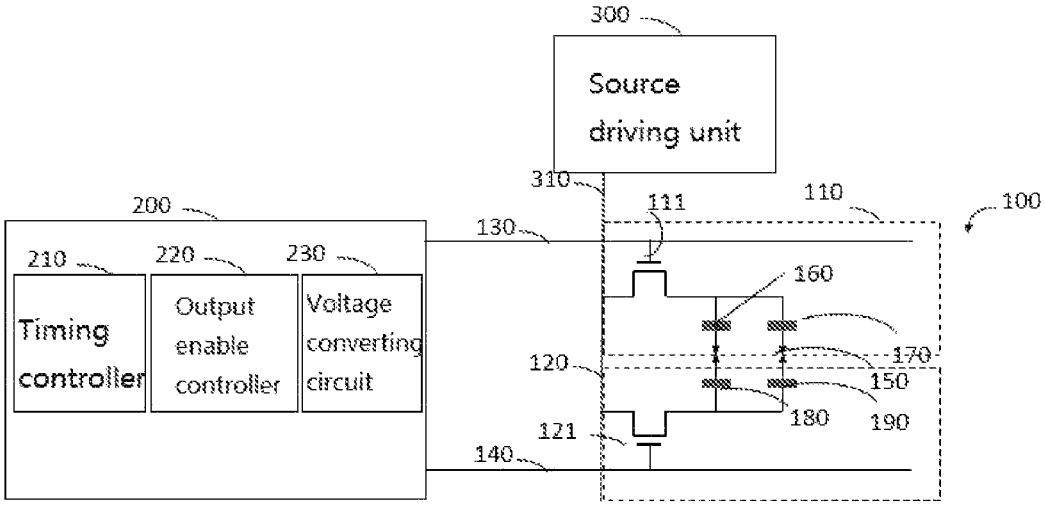
FIG. 7 is a structural view of a pixel in a driving device for a display panel according to an embodiment of the disclosure.

Referring to FIGS. 6-7, in one of the embodiments, the disclosure further provides a driving device for a display panel. The driving device for a display panel includes numerous sub-pixels 100. Each of the sub-pixels 100 includes the first display region 110 and the second display region 120.

The driving device for a display panel further includes the gate driving unit 200. The gate driving unit 200 includes the timing controller 210, the output enable controller 220, and the voltage converting circuit 230. The timing controller 210, the output enable controller 220 and the voltage converting circuit 230 are electrically connected in sequence.

The driving device for a display panel further includes the first scanning line 130 and the second scanning line 140. One end of the first scanning line 130 and the first display regions 110 are connected. The other end of the first scanning line 130 and the voltage converting circuit 230 are electrically connected. One end of the second scanning line 140 and the second display regions 120 are connected. The other end of the second scanning line 140 and the voltage converting circuit 230 are electrically connected. The driving device for a display panel further includes the source driving unit 300. The source driving unit 300 is configured to output signals. The driving device for a display panel further includes a data line 310. One end of the data line 310 and the source driving unit 300 are connected. The other end of the data line 310 is connected with the first display regions 110 and the second display regions 120.

The signal output from the source driving unit 300 charges the first display regions 110 and the second display regions 120 by the data line 310. The gate driving unit 200 respectively controls the time of the data signal charging the first display regions 110 and the second display regions 120 by the first scanning line 130 and the second scanning line 140. In one embodiment of the disclosure, the first display region 110 and the second display region 120 respectively are disposed with a first switch 111 and a second switch 121 configured to control the first display region 110 and the second display region 120 to be charged. The gate driving unit 200 respectively controls the first switch 111 and the second switch 121 to be turned on/off by the first scanning line 130 and the second scanning line 140. The first switch 111 and the second switch 121 can be thin film transistors. The first switch 111 and the second switch 121 can include source electrodes, gate electrodes and drain electrodes. The scanning voltage can be changed by controlling a gate resistor 223 by the first scanning line 130 and the second scanning line 140. When the resistance is high, the first switch 111 and the second switch 121 are turned off. When the resistance is low, the first switch 111 and the second switch 121 are turned on.

In one of the embodiments, the source driving unit 300 further includes the data line 310. The data line 310 is connected with the source electrode of the first switch 111 and the source electrode of the second switch 121 in each of the sub-pixels 100. The gate driving unit 200 controls the first switch 111 or the second switch 121 to be turned on for enabling the source driving unit 300 to charge the first display regions 110 and the second display regions 120 by the data line 310. The period of keeping the first switch 111 and the second switch 121 turned on is the period of charging the first display regions 110 and the second display regions 120.

In one of the embodiments, the sub-pixel 100 further includes a common electrode 150. The first display region 110 further includes a first liquid crystal capacitor 160 and a first storage capacitor 170. The second display region 120 further includes a second liquid crystal capacitor 180 and a second storage capacitor 190. Two ends of the first liquid crystal capacitor 160 and the first storage capacitor 170 respectively are connected with the drain electrode of the first switch 111 and the common electrode 150. Two ends of the second liquid crystal capacitor 180 and the second storage capacitor 190 respectively are connected with the drain electrode of the second switch 121 and the common electrode 150. Within a permissive scale, when the time of charging the first liquid crystal capacitor 160 and the second liquid crystal capacitor 180 is longer, the brightness of the sub-pixels 100 will be greater. The first storage capacitor 170 and the second storage capacitor 190 can respectively maintain voltages of the first liquid crystal capacitor 160 and the second liquid crystal capacitor 180, further keeping the image on.

The disclosure further provides a driving method of a display panel. The method includes:

S100, turning on switches of first display regions and second display regions of each sub-pixel by respectively controlling a source driving unit.

S200, after the first display regions and the second display regions are turned on, charging the first display regions and the second display regions by the source driving unit.

S300, times to turn off the switches of the first display region and the second display region through the gate driving unit, and thereby times of charging the first display region and the second display region through the source driving unit are controlled.

The display panel can be a TN, an OCB, a VA type, a curved display panel, and so on. The display panel is applied in a display device. The display device can utilize direct-lit backlight. The backlight can be white light, RGB tricolor light, RGBW four-color light or RGBY four-color light, and others.

Furthermore, each functional element in the embodiments of the disclosure can be integrated in one processor, or each element can be separated, as well as two or more than two elements integrated in one element. The integrated elements above can be achieved by hardware and hardware with software.

The elements achieved by software functional elements can be stored in computer readable storage media. The software functional elements are stored in one storage medium, including some commands for enabling a processor of a computing device such as a personal computer, a server or a network equipment to run steps of the method of the embodiments of the disclosure. The storage media described above includes various media capable of storing codes such as a USB disk, a mobile hard disk, a read-only memory (ROM), a random access memory (RAM), a magnetic disc or an optical disk.

If an element is described to be "fixed on" another element, the element can be directly on another element or an intermediate element can exist. When one element is regarded to be "connected to" the other element, the element can be directly connected to the other element or an intermediate element can exist simultaneously. On the contrary, when an element is called to be "immediately on" another element, no intermediate element will appear. Terms "vertical", "horizontal", "left", "right" and other similar expression used in the disclosure are merely for the purpose of illustration.

The foregoing embodiments merely deliver some embodiments of the disclosure. The description is relatively concrete and detailed, but cannot be understood as restriction to the scope of the disclosure. Equivalent structures and improvements according to the spirit of the disclosure obtained by a person skilled in the art are all included in the protection scope of the disclosure. Therefore, the protective scope of the disclosure should be based on the attached claims.

What is claimed is:

1. A driving device for a display panel comprising:

a plurality of sub-pixels, wherein each of the plurality of sub-pixels comprises a first display region and a second display region;

a first scanning line and a second scanning line, wherein the first scanning line is connected to the first display regions of the plurality of sub-pixels, and the second scanning line is connected to the second display regions of the plurality of sub-pixels;

at least one gate driving unit, individually connected to the first scanning line and the second scanning line;

wherein the gate driving unit is configured to control charging times of the first display regions and the second display regions respectively through the first scanning line and the second scanning line and thereby to control grayscale displays of the first display regions and the second display regions;

wherein the gate driving unit comprises a timing controller and an output enable controller connected to the timing controller, and the timing controller is configured to control duty ratios of high level scanning signals;

wherein the timing controller is further configured to control the charging times of the first display region and the second display region respectively through adjusting the duty ratios of the high level scanning signals;

wherein the timing controller is further configured to make the output enable controller to output control signals by controlling the duty ratios of the high level scanning signals, and the control signals are configured to control the first display region and the second display region to be charged or powered off;

wherein the output enable controller comprises a first field effect transistor and a second field effect transistor;

wherein a source electrode of the first field effect transistor is connected to a gate electrode of the second field effect transistor, the source electrode of the first field effect transistor and the gate electrode of the second field effect transistor are connected to a power supply, a drain electrode of the first field effect transistor and a drain electrode of the second field effect transistor are grounded;

wherein a gate electrode of the first field effect transistor is configured to be inputted with a signal outputted from the timing controller, and the signal is the high level scanning signal with the adjusted duty ratio.

2. The driving device for a display panel according to claim 1, wherein the gate driving unit further comprises a voltage converting circuit, and the voltage converting circuit is connected to the output enable controller; the voltage converting circuit is configured to convert the control signals outputted from the output enable controller into scanning voltages for controlling the first display region and the second display region to be charged.

3. The driving device for a display panel according to claim 1, wherein the driving device for a display panel comprises a source driving unit for outputting a data signal, and the source driving unit is configured to output the data signal to charge the first display region and the second display region of each of the plurality of sub-pixels, the gate driving unit is configured to control times of the data signal charging the first display region and the second display region respectively by the first scanning line and the second scanning line.

4. The driving device for a display panel according to claim 3, wherein the first display regions and the second display regions of the plurality of sub-pixels respectively are disposed with a first switch and a second switch for controlling charges of the first display region and the second display region, the first switch and the second switch respectively are connected to the first scanning line and the second scanning line, the gate driving unit is configured to control the first switch and the second switch to be turned on or off respectively by the first scanning line and the second scanning line.

5. The driving device for a display panel according to claim 4, wherein the source driving unit is disposed with a data line, the data line is connected to a source electrode of the first switch and a source electrode of the second switch in each of the plurality of sub-pixels, the gate driving unit is configured to control the first switch or the second switch to be turned on and thereby to make the source driving unit to charge the first display region and the second display region through the data line.

6. A driving device for a display panel comprising:

a plurality of sub-pixels, wherein each of the plurality of sub-pixels comprises a first display region and a second display region;

a gate driving unit, wherein the gate driving unit comprises a timing controller, an output enable controller and a voltage converting circuit, the timing controller, the output enable controller and the voltage converting circuit are electrically connected in sequence;

a first scanning line and a second scanning line, wherein an end of the first scanning line is connected to the first display regions of the plurality of sub-pixels, and another end of the first scanning line is electrically connected to the voltage converting circuit, an end of the second scanning line is connected to the second display regions of the plurality of sub-pixels, and another end of the second scanning line is electrically connected to the voltage converting circuit;

a source driving unit, wherein the source driving unit is configured to output a data signal;

a data line, wherein an end of the data line is connected to the source driving unit, and another end of the data line is connected to the first display region and the second display region;

wherein the data signal outputted from the source driving unit charges the first display region and the second display region through the data line, the gate driving unit controls times of the data signal charging the first display region and the second display region respectively through the first scanning line and the second scanning line;

wherein the output enable controller comprises a first field effect transistor and a second field effect transistor;

wherein a source electrode of the first field effect transistor is connected to a gate electrode of the second field effect transistor, the source electrode of the first field effect transistor and the gate electrode of the second field effect transistor are connected to a power supply, a drain electrode of the first field effect transistor and a drain electrode of the second field effect transistor are grounded;

wherein a gate electrode of the first field effect transistor is configured to be inputted with a signal outputted from the timing controller, and the signal is a high level scanning signal with an adjusted duty ratio.

7. A driving method of a display panel, comprising:

controlling switches of a first display region and a second display region of a sub-pixel to be turned on through a gate driving unit;

after the switches of the first display region and the second display region are turned on, charging the first display region and the second display region through a source driving unit;

controlling times to turn off the switches of the first display region and the second display region through the gate driving unit, and thereby times of charging the first display region and the second display region through the source driving unit are controlled;

wherein the gate driving unit comprises a timing controller and an output enable controller connected to the timing controller, and the timing controller is configured to control duty ratios of high level scanning signals;

wherein the timing controller is further configured to control charging times of the first display region and the second display region respectively by adjusting the duty ratios of the high level scanning signals;

wherein the timing controller makes the output enable controller to output control signals by controlling the duty ratios of the high level scanning signals, and the control signals are configured to control the first display region and the second display region to be charged or powered off;

wherein the output enable controller comprises a first field effect transistor and a second field effect transistor;

wherein a source electrode of the first field effect transistor is connected to a gate electrode of the second field effect transistor, the source electrode of the first field effect transistor and the gate electrode of the second field effect transistor are connected to a power supply, a drain electrode of the first field effect transistor and a drain electrode of the second field effect transistor are grounded;

wherein a gate electrode of the first field effect transistor is configured to be inputted with a signal outputted from the timing controller, and the signal being the high level scanning signal with the adjusted duty ratio.

8. The driving method of a display panel according to claim 7, wherein the gate driving unit further comprises a voltage converting circuit, and the voltage converting circuit is connected to the output enable controller; the voltage converting circuit is configured to convert the control signals outputted from the output enable controller into scanning voltages for controlling the first display region and the second display region to be charged.

* * * * *